US005613410A

United States Patent [19]

Kim

[11] Patent Number: 5,613,410

[45] Date of Patent: Mar. 25, 1997

[54] ADJUSTABLE HEAD STRUCTURE FOR WRENCHES

[76] Inventor: Kwang-Moo Kim, 755-3, Kyomoon-Dong, Koori, Kyunggi-Do, Rep. of Korea

[21] Appl. No.: 580,247

[22] Filed: Dec. 28, 1995

[30] Foreign Application Priority Data

Jul. 4, 1995 [KR] Rep. of Korea ..... 95-16373

[51] Int. Cl.[6] ..... B25B 13/58

[52] U.S. Cl. ..... 81/185.1; 81/185; 81/DIG. 11

[58] Field of Search ..... 81/185, 185.1, 81/DIG. 11

[56] References Cited

U.S. PATENT DOCUMENTS

| | | | |
|---|---|---|---|
| 810,599 | 1/1906 | Ansorge | 81/185 X |
| 2,500,835 | 3/1950 | Lang . | |
| 2,758,493 | 8/1956 | Goldwater | 81/185.1 X |
| 3,877,328 | 4/1975 | Sullivan | 81/185 |

FOREIGN PATENT DOCUMENTS

| | | | |
|---|---|---|---|
| 85-1175 | 6/1985 | Rep. of Korea . | |
| 86-3147 | 11/1986 | Rep. of Korea . | |
| 1464808 | 2/1977 | United Kingdom | 81/185 |

*Primary Examiner*—James G. Smith
*Attorney, Agent, or Firm*—Barbara A. Fisher

[57] ABSTRACT

An adjustable head structure for wrenches is disclosed. The head structure has a head unit integrally formed with or separately formed from a wrench handle. The head unit is commonly used for tightening or loosening nuts and bolts having different sizes by detachably fitting a size adjusting block in one of fitting edges of a size adjusting opening eccentrically formed in the head unit. The head unit has a polygonal depression having side walls. The size adjusting opening having a plurality of fitting edges is eccentrically formed on the bottom of the depression such that the distances from the fitting edges to associated side walls of the depression are different from each other. A size adjusting block is selectively and detachably fitted in one of the fitting edges of the opening, thereby adjusting a grip size of the head unit.

4 Claims, 4 Drawing Sheets

ADJUSTABLE HEAD STRUCTURE FOR WRENCHES

BACKGROUND OF THE INVENTION

1. Field of the Invention

The present invention relates in general to an adjustable head structure for wrenches having a head unit integrally formed with or separately formed from a wrench handle and, more particularly, to a structural improvement in such a head unit for commonly using the head unit for tightening or loosening nuts and bolts of different sizes by detachably fitting a size adjusting block in the head unit.

2. Description of the Prior Art

In typical wrenches used for tightening and loosening nuts and bolts, a grip opening formed between the jaws of a wrench head has a fixed grip size. Therefore, the typical wrench has a problem in that several wrenches having different grip sizes must be prepared to selectively use the wrenches for tightening or loosening nuts and bolts having different sizes. As these several wrenches having different sizes must be prepared as described above, the wrenches may be lost forcing the owner to purchase new ones.

In order to rectify the above problem of the wrenches having fixed grip sizes, U.S. Pat. No. 2,500,835 discloses a ratchet wrench which is shown in the accompanying drawing, FIG. 1. As shown in the drawing, the head 1 of the above wrench has a ratchet 3 which is biased by a torsion spring 2. In addition, a rotary head unit 6 is rotatably mounted in the wrench head 1. The above head unit 6 is toothed on its outer surface thereby forming a ratchet gear 4. The center of the above unit 6 is provided with a grip opening 5 having a fixed size. The ratchet gear 4 engages with the ratchet 3. The above U.S. ratchet wrench is somewhat preferably used for tightening or loosening a nut or bolt while rotating the head unit 6 in a forward or reverse direction in accordance with the ratchet direction. However, as the above ratchet wrench has a fixed grip size, it is impossible to commonly use the ratchet wrench for tightening or loosening nuts and bolts having different sizes.

On the other hand, Korean U.M. Publication Nos. 85-1175 and 86-3147 disclose adjustable socket wrenches which can be commonly used for tightening or loosening nuts and bolts having different sizes. In each of the above adjustable socket wrenches, the wrench head has an adjustable grip opening whose size can be adjusted by moving a movable jaw relative to a fixed jaw. The movement of the movable jaw relative to the fixed jaw is performed by the turning motion of an adjusting worm. However, it has been noted that the above adjustable socket wrenches have the following problems. That is, as the size of the grip opening of each of the above socket wrenches is adjusted by the turning motion of the adjusting worm, the adjusting worm may be abraded or broken due to the pressure repeatedly applied thereto whenever tightening or loosening nuts and bolts. In addition, the adjusting worm has to be turned in order to adjust the size of the adjustable grip opening according to the size of a bolt or nut whenever tightening or loosening nuts and bolts having different sizes. Therefore, the operational efficiency of the above Korean wrenches is reduced. The construction of above adjustable socket wrench is complicated thereby increasing the cost. Another problem of the above socket wrench is resided in that the adjustable size of the grip opening is limited to a predetermined range.

SUMMARY OF THE INVENTION

It is, therefore, an object of the present invention is provide an adjustable head structure for wrenches in which the above problems can be overcome and which has a head unit integrally formed with or separately formed from a wrench handle and commonly used for tightening or loosening nuts and bolts having different sizes by detachably fitting a size adjusting block in one of the fitting edges of a size adjusting opening eccentrically formed in the head unit.

In order to accomplish the above object, the wrench head unit according to the present invention has a polygonal depression having a plurality of side walls. The polygonal depression is formed on the top center of the head unit. The size adjusting opening is formed on the bottom of the polygonal depression and has a plurality of fitting edges. The size adjusting opening is eccentrically formed on the bottom of the depression such that the distances from the fitting edges of the opening to associated side walls of the polygonal depression are different from each other. The head unit also includes a size adjusting block which is selectively and detachably fitted in one of the fitting edges of the size adjusting opening, thereby adjusting a grip size of the head unit.

BRIEF DESCRIPTION OF THE DRAWINGS

The above and other objects, features and other advantages of the present invention will be more clearly understood from the following detailed description taken in conjunction with the accompanying drawings, in which:

FIGS. 7 to 9 are plan views showing the adjustable sizes of the head structure of the present invention respectively, in which:

FIG. 7 shows the head structure in the second size;

FIG. 8 shows the head structure in the third size; and

FIG. 9 shows the head structure in the fourth size.

DESCRIPTION OF THE PREFERRED EMBODIMENTS

Figure 2:
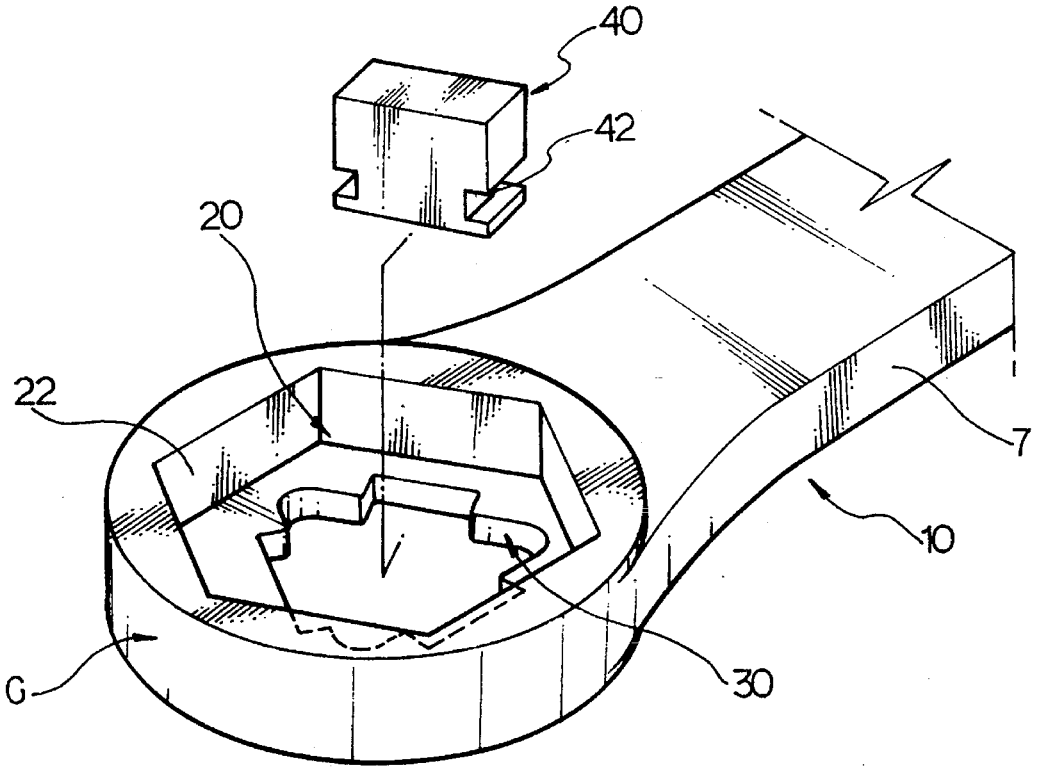
FIG. 2 is an exploded perspective view of an adjustable head structure for wrenches having a head unit in accordance with an embodiment of the present invention.
Figure 3:
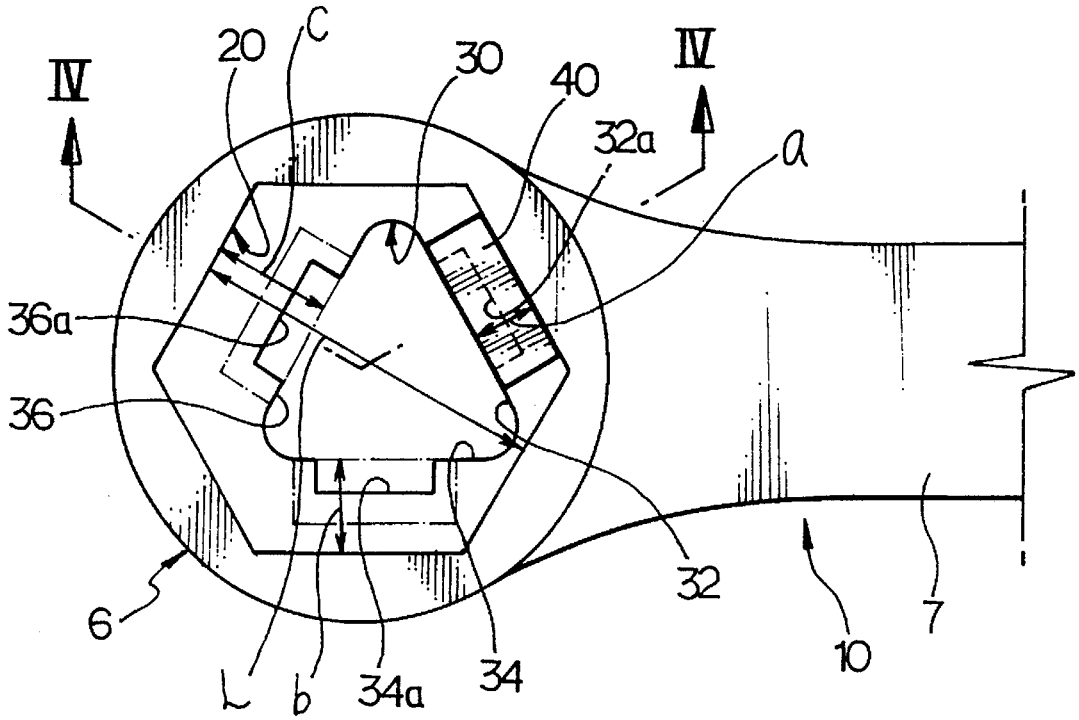
FIG. 3 is a plan view showing an example of the position of size adjusting block detachably fitted in one of fitting notches of the head unit of FIG. 2.
Figure 4:
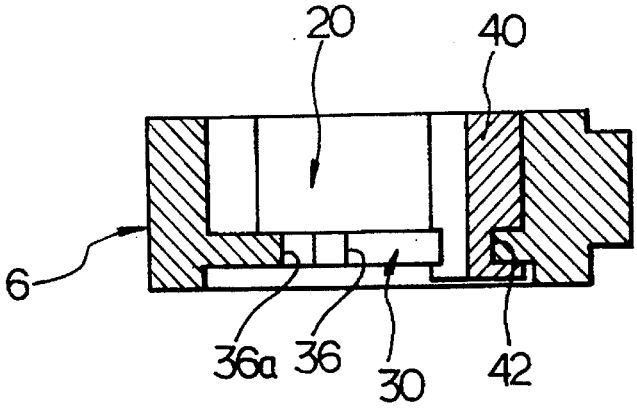
FIG. 4 is a sectional view of the head unit taken along the section line IV—IV of FIG. 3.
Figure 5:
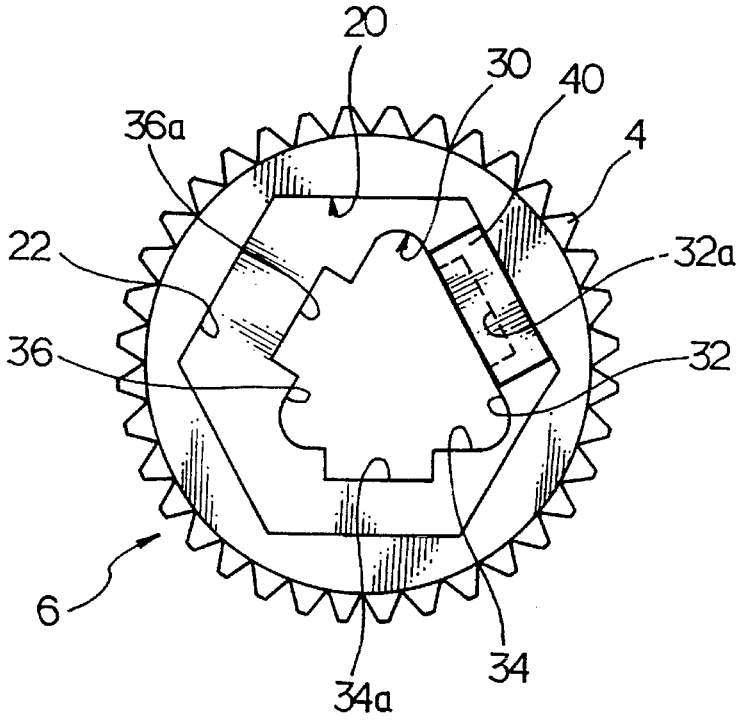
FIG. 5 is a plan view of a head structure in accordance with another embodiment of the present invention.
Figure 6:
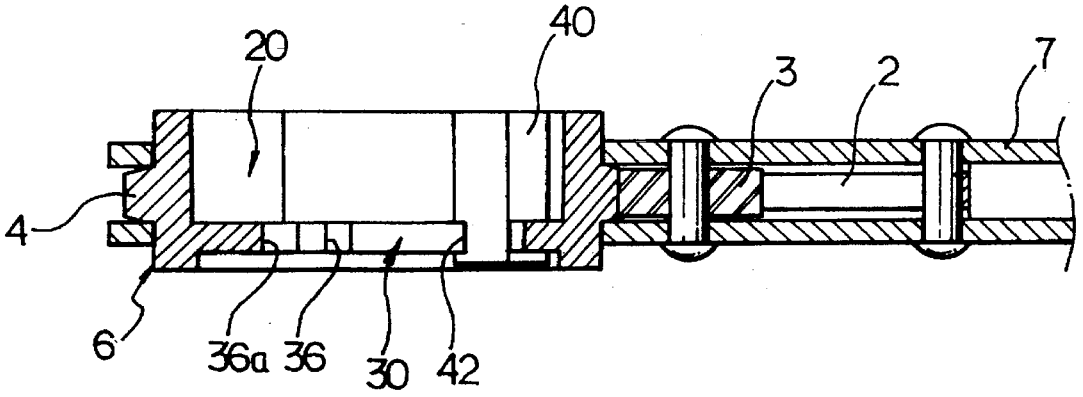
FIG. 6 is a sectional view of a wrench provided with the head structure of FIG. 5.

FIGS. 2 to 4 show a head structure in accordance with a primary embodiment of the present invention, while FIGS. 5 and 6 show a head structure in accordance with a second embodiment of the present invention. Regardless of the embodiments, the head structure of this invention has a head unit 6. The above head unit 6 may be either integrally formed with a wrench body having a wrench handle 7 as shown in FIGS. 2 to 4. Alternatively, the unit 6 may be separately formed from the wrench body as shown in FIGS. 5 and 6. When the above head unit 6 is separately formed from the wrench body, the unit 6 is rotatably mounted to the wrench head extending from the wrench handle 7. The center of the above head unit 6 is depressed to form a polygonal depression 20 having a plurality of side walls 22. The bottom of the polygonal depression 20 in turn is eccentrically bored to form a size adjusting opening 30 having a plurality of fitting edges. In the embodiments of this invention, the opening 30 has a generally triangular configuration. In this case, the vertexes of the triangular opening 30 are smoothly rounded. As the opening 30 is eccentrically formed on the depression's bottom, the distances between the fitting edges of the size adjusting opening 30 and associated side walls 22 of the polygonal depression 20 are different from each other. The head structure according to the present invention also includes a size adjusting block 40. The block 40 is selectively and detachably fitted in one of the fitting edges of the above opening 30, thereby adjusting the grip size of the head unit 6.

In the above head unit 6, the polygonal depression 20 has a size which can receive the head of the largest bolt or nut when the adjusting block 40 is not fitted in the head unit 6. For example, the above polygonal depression 20 may have a hexagonal configuration as shown in FIGS. 2, 3 and 5.

As shown in FIGS. 2 and 3, the eccentrically formed size adjusting opening 30 has a plurality of fitting edges 32, 34 and 36. The distances between the fitting edges 32, 34 and 36 of the above size adjusting opening 30 and associated side walls 22 of the polygonal depression 20 are different from each other as described above. Each fitting edge 32, 34, 36 of the opening 30 is notched to form a block fitting notch 32*a*, 34*a*, 36*a*. The size adjusting block 40 may be selectively and detachably fitted in one of the above fitting notches 32*a*, 34*a* and 36*a*.

The above size adjusting block 40 has a generally cubic configuration as best seen in FIG. 2. The block 40 having a given width is provided with a plurality of fitting slots 42 for being detachably fitted in one of the notches 32*a*, 34*a* and 36*a* of the opening 30. The fitting slots 42 are horizontally formed on both side surfaces and on the rear surface of the block 40. In the present invention, it is preferable to form the block 40 using a magnetic material and to form the fitting edges of the opening 30 using a metal which can be easily magnetized. In this case, the block 40 can be brought into magnetic engagement with or easily removed from one of the notches 32*a*, 34*a* and 36*a*.

In the primary embodiment shown in FIGS. 2 to 4, the head unit 6 having the above-mentioned construction is integrally formed with the wrench handle 7.

Figure 1:
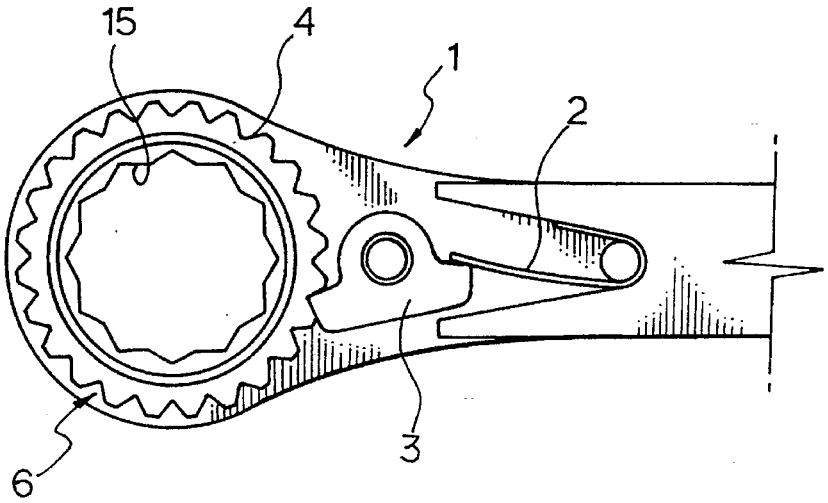
FIG. 1 is a plan view of a typical ratchet wrench.

However, in the second embodiment of FIGS. 5 and 6, the head unit 6 having the above-mentioned construction is separately formed from the handle 7. The above head unit 6 of the second embodiment is rotatably mounted in the wrench head extending from the handle 7. The head unit 6 is toothed on its outer surface thereby forming a ratchet gear 4 in the same manner as described for the typical ratchet wrench of FIG. 1. The ratchet gear 4 engages with a ratchet 3 biased by a torsion spring 2 as shown in FIG. 6.

In the drawings, the reference character L denotes the diameter of the polygonal depression 20. The reference character a, b, c denotes the distance from the inside surface of the block 40 to a side wall 22 of the depression 20 when the block 40 is fitted in each notch 32*a*, 34*a*, 36*a* of the opening 30.

The operational effect of the head structure of the present invention will be described hereinbelow.

Figure 7:
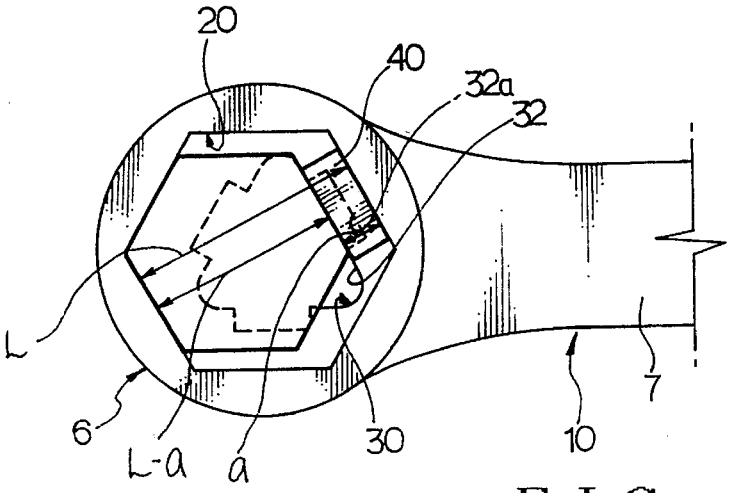
Figure 8:
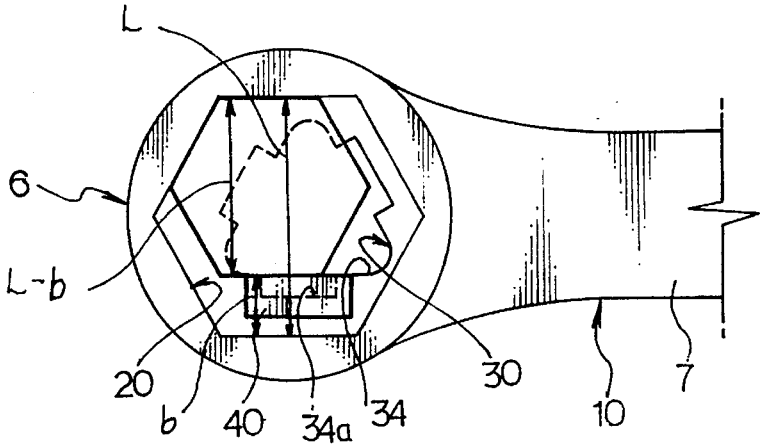
Figure 9:
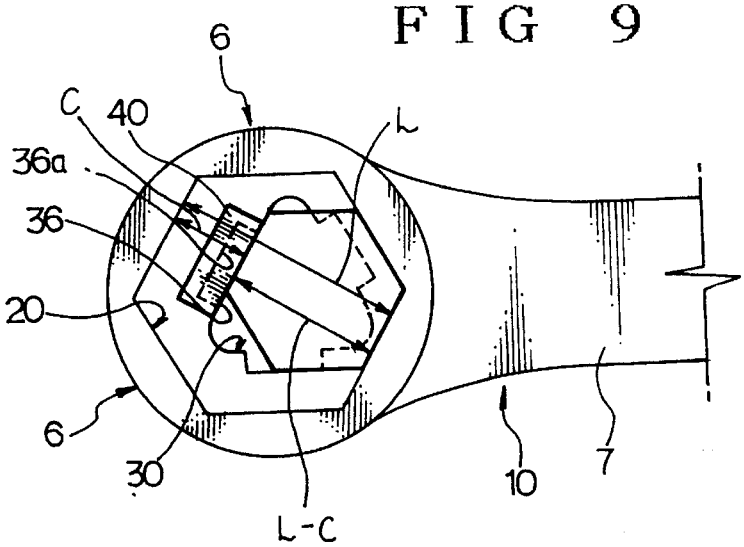

As shown in FIGS. 7 to 9, the grip size of the head structure of the present invention regardless of the embodiments can be adjusted to be commonly used for tightening or loosening bolts or nuts having different sizes. That is, when the size adjusting block 40 is fitted in the first notch 32*a* of the opening 30 as shown in FIG. 7, the grip size of the head unit 6 is changed into L-a, that is, the result of subtracting the distance "a" from the diameter L of the depression 20. The head unit 6 in the above state is used for tightening or loosening a bolt or nut having a head size L-a. When the size adjusting block 40 is fitted in the second notch 34*a* of the opening 30 as shown in FIG. 8, the grip size of the head unit 6 is changed into L-b, that is, the result of subtracting the distance "b" from the depression's diameter L. The unit 6 in the above state is used for tightening or loosening a bolt or nut having a head size L-b. When the block 40 is fitted in the third notch 36*a* of the opening 30 as shown in FIG. 9, the grip size of the head unit 6 is changed into L-c, that is, the result of subtracting the distance "c" from the depression's diameter L. The unit 6 in the above state is used for tightening or loosening a bolt or nut having a head size L-c. When the block 40 is not fitted in the unit 6, the unit 6 has a grip size L. That is, the above head unit 6 has four adjustable sizes L, L-a, L-b and L-c. The head unit 6 is thus commonly used for tightening or loosening nuts and bolts having different sizes while adjusting its grip size between L, L-a, L-b and L-c.

As described above, the present invention provides an adjustable head structure for wrenches. The above head structure has a head unit which may be integrally formed with or separately formed from a wrench body. The center of the head unit is depressed to form a polygonal depression. The bottom of the depression is eccentrically bored to form a size adjusting opening having a plurality of fitting edges. As the opening is eccentrically formed on the depression's bottom, the distances between the fitting edges of the opening and associated side walls of the depression are different from each other. Each fitting edge of the size adjusting opening is notched to formed a fitting notch. The head unit also includes a size adjusting block which is detachably fitted in one of the fitting notches of the opening, thereby adjusting the grip size of the head unit. The head structure of this invention can be commonly used for tightening or loosening nuts and bolts having different sizes while adjusting its grip size by detachably fitting the block in one of the fitting notches. In addition, as the block has a plurality of fitting slots horizontally formed on both side and rear surfaces of the block, the block is stably fitted in and easily removed from the fitting notches.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An adjustable head structure for wrenches having a head unit integrally formed with or rotatably mounted to a wrench handle, wherein said head unit includes:

a polygonal depression having a plurality of side walls, said polygonal depression being formed on a top surface of said head unit;

a size adjusting opening formed on the bottom of said polygonal depression and having a plurality of fitting edges, said opening being eccentrically formed on said bottom of the depression such that distances from said fitting edges to associated side walls of said polygonal depression are different from each other; and a size adjusting block being selectively and detachably fitted in one of said fitting edges of the size adjusting opening, thereby adjusting a grip size of said head unit.

2. The adjustable head structure according to claim 1, wherein said polygonal depression has a hexagonal configuration, and each fitting edge of said size adjusting opening is notched to form a block fitting notch for detachably fitting said size adjusting block to each fitting edge.

3. The adjustable head structure according to claim 2, wherein said size adjusting block is a cubic body having a predetermined width and provided with a plurality of fitting slots detachably engaging with one of said fitting notches of the size adjusting opening, said fitting slots being formed on both side and rear surfaces of said cubic body.

4. The adjustable head structure according to claim 1 or 3, wherein said size adjusting block is formed of a magnetic material, and said fitting edges of the size adjusting opening are formed of a magnetizable metal, thereby being brought into detachable magnetic engagement with said block.

* * * * *